US008702093B2

(12) United States Patent
Hirahara

(10) Patent No.: US 8,702,093 B2
(45) Date of Patent: Apr. 22, 2014

(54) SHEET LOADING DEVICE AND IMAGE READING APPARATUS HAVING AUXILIARY RESTRICTING MEMBER

(71) Applicant: KYOCERA Document Solutions Inc., Osaka (JP)

(72) Inventor: Kazuhisa Hirahara, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/771,536

(22) Filed: Feb. 20, 2013

(65) Prior Publication Data

US 2013/0214483 A1 Aug. 22, 2013

(30) Foreign Application Priority Data

Feb. 22, 2012 (JP) ..... 2012-035996

(51) Int. Cl.
*B65H 3/56* (2006.01)

(52) U.S. Cl.
CPC ..... *B65H 3/56* (2013.01)
USPC ..... 271/169; 271/127; 271/171

(58) Field of Classification Search
USPC ..... 271/127, 167, 169, 170, 171, 238, 240
See application file for complete search history.

(56) References Cited

U.S. PATENT DOCUMENTS

| | | | | |
|---|---|---|---|---|
| 6,409,165 | B1 * | 6/2002 | Yamaoka et al. | 271/171 |
| 7,377,509 | B2 * | 5/2008 | Ito | 271/171 |
| 7,527,258 | B2 * | 5/2009 | Ito | 271/171 |
| 2012/0306148 | A1 * | 12/2012 | Yamagishi et al. | 271/121 |

FOREIGN PATENT DOCUMENTS

| | | | |
|---|---|---|---|
| JP | 03-138224 | | 6/1991 |
| JP | 2000-118730 | | 4/2000 |
| JP | 2000-219330 | | 8/2000 |
| JP | 2005-75492 | | 3/2005 |
| JP | 2005075492 | A * | 3/2005 |
| JP | 2009-46293 | | 3/2009 |
| JP | 2011-152993 | | 8/2011 |

* cited by examiner

*Primary Examiner* — Gerald McClain
(74) *Attorney, Agent, or Firm* — Gerald E. Hespos; Michael J. Porco; Matthew T. Hespos

(57) ABSTRACT

A sheet loading device includes a sheet tray, a lift plate, a restricting part, and an auxiliary restricting member. The restricting part is movable to a plurality of predetermined fixed positions and restricts a position of the sheets in a sheet width direction. The auxiliary restricting member is disposed on the one edge side of the restricting part. The auxiliary restricting member restricts, with first biasing force, the side edge of the sheets lifted by the lift plate when the number of sheets housed in the sheet tray is a first number of sheets, and restricts, with second biasing force that is greater than the first biasing force, the side edge of the sheets lifted by the lift plate when the number of sheets housed in the sheet tray is a second number of sheets that is greater than the first number of sheets.

16 Claims, 8 Drawing Sheets

SHEET LOADING DEVICE AND IMAGE READING APPARATUS HAVING AUXILIARY RESTRICTING MEMBER

This application relates to and claims priority from Japanese Patent Application No. 2012-035996, filed on Feb. 22, 2012 with the Japan Patent Office, the entire disclosure of which is incorporated herein by reference.

BACKGROUND

A sheet loading device which has a sheet loading part on which a plurality of sheets are loaded and in which the sheets are fed from the sheet loading part is suitably used, for example, in image forming apparatuses such as copiers, printers, facsimiles or multi-function machines having the foregoing functions. In an image forming apparatus, sheets are fed one by one from the sheet loading device to the image forming unit. Subsequently, an image is formed on the sheet in the image forming unit.

Conventionally, with this kind of sheet loading device, the sheet loading part in which the sheets are loaded has a cassette structure that can be pulled out from the image forming apparatus body in order to replenish the sheets to be used. The sheet loading part has a pair of guide members for restricting the displacement of the sheets in the width direction in order to stabilize the feeding of the sheets. The pair of guide members is formed, in many cases, to be movable in the width direction of the sheets. The guide members are provided with a rack having a teeth part formed in a predetermined pitch in the sheet width direction. Moreover, the bottom part of the sheet loading part is provided with a pinion gear which engages with the teeth part. Of the pair of guide members, when one guide member is moved in the sheet width direction, the moving force thereof is transmitted to the other guide member by means of the engagement of the teeth part of the rack and the pinion gear. Thus, the pair of guide members moves in conjunction with each other in mutually opposite directions. Consequently, the positions of the guide members are adjusted with respect to the plurality of types of sheets having different sheet widths respectively.

The width of the sheets loaded in the sheet loading part has a predetermined tolerance. In other words, even if the sheets are of the same type, the sheet width is slightly different for each sheet. Thus, in order to prevent the width direction end of a sheet having a slightly wide width from coming into contact with the guide member and buckling, the fixed position of the guide member needs to be determined in consideration of the maximum tolerance of the sheets in the width direction. Consequently, a gap is generated between the guide member and the sheets in many cases.

The present disclosure has been devised in order to resolve the foregoing problem, and an object of this disclosure is to provide a sheet loading device which realizes the accurate positioning of sheets in the width direction, and an image forming apparatus having the foregoing sheet loading device.

SUMMARY

The sheet loading device according to one aspect of the present disclosure includes a sheet tray, a lift plate, a restricting part, and an auxiliary restricting member. The sheet tray has a sheet housing space for housing a plurality of sheets. The lift plate is disposed in the sheet housing space, has a top face as a loading face for loading the sheets, and lifts one edge of the sheets upward. The restricting part is movable among a plurality of predetermined fixed positions and is disposed facing a side edge of the sheets which intersects with the one edge of the sheets. The restricting part restricts a position of the sheets in a sheet width direction. The auxiliary restricting member is disposed on the one edge side of the restricting part in a manner of protruding toward the side edge of the sheets housed in the sheet tray. The auxiliary restricting member restricts, with first biasing force, the side edge of the sheets lifted by the lift plate when the number of sheets housed in the sheet tray is a first number of sheets, and restricts, with second biasing force that is greater than the first biasing force, the side edge of the sheets lifted by the lift plate when the number of sheets housed in the sheet tray is a second number of sheets that is greater than the first number of sheets.

Moreover, in the sheet loading device according to another aspect of the present disclosure, the auxiliary restricting member restricts, at a first position, the side edge of the sheets lifted by the lift plate when the number of sheets housed in the sheet tray is the first number of sheets, and restricts, at a second position that is nearer to the sheet side than the first position, the side edge of the sheets lifted by the lift plate when the number of sheets housed in the sheet tray is the second number of sheets that is greater than the first number of sheets.

Moreover, the image forming apparatus according to yet another aspect of the present disclosure includes an image forming unit, the foregoing sheet loading device, and a sheet feeding path. The image forming unit forms an image on a sheet. The sheet feeding path extends from the sheet tray to the image forming unit and the sheet is fed thereon.

DETAILED DESCRIPTION

One embodiment of the present disclosure is now explained with reference to the appended drawings. Note that the term "sheet" as used in the ensuing explanation refers to copy paper, coated paper, OHP sheet, cardboard, postcards, tracing paper and other sheet materials to be subject to the image forming process or sheet materials to be subject to arbitrary processes other than the image forming process.

Figure 1:
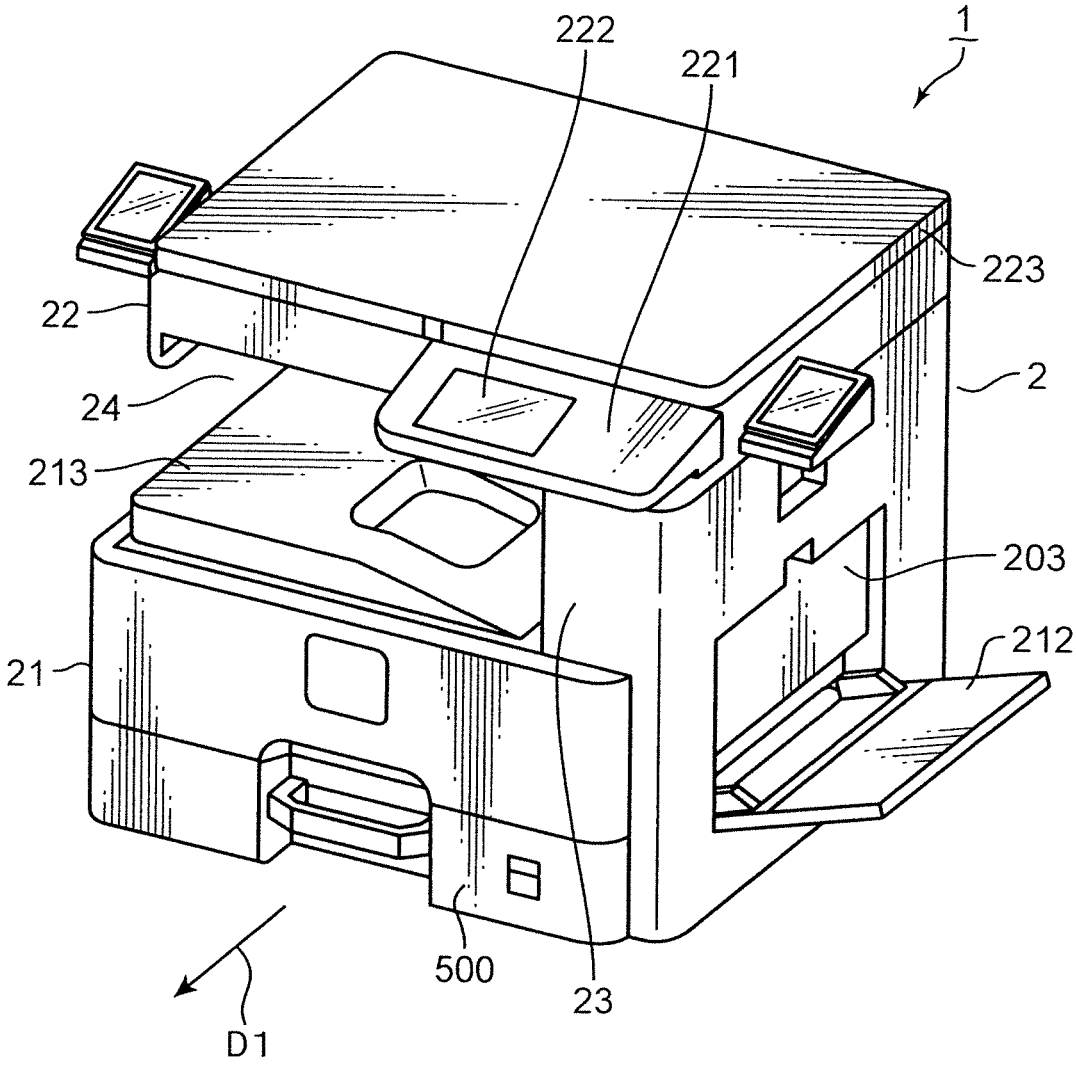
FIG. 1 is a perspective view of the image forming apparatus according to one embodiment of the present disclosure.
Figure 2:
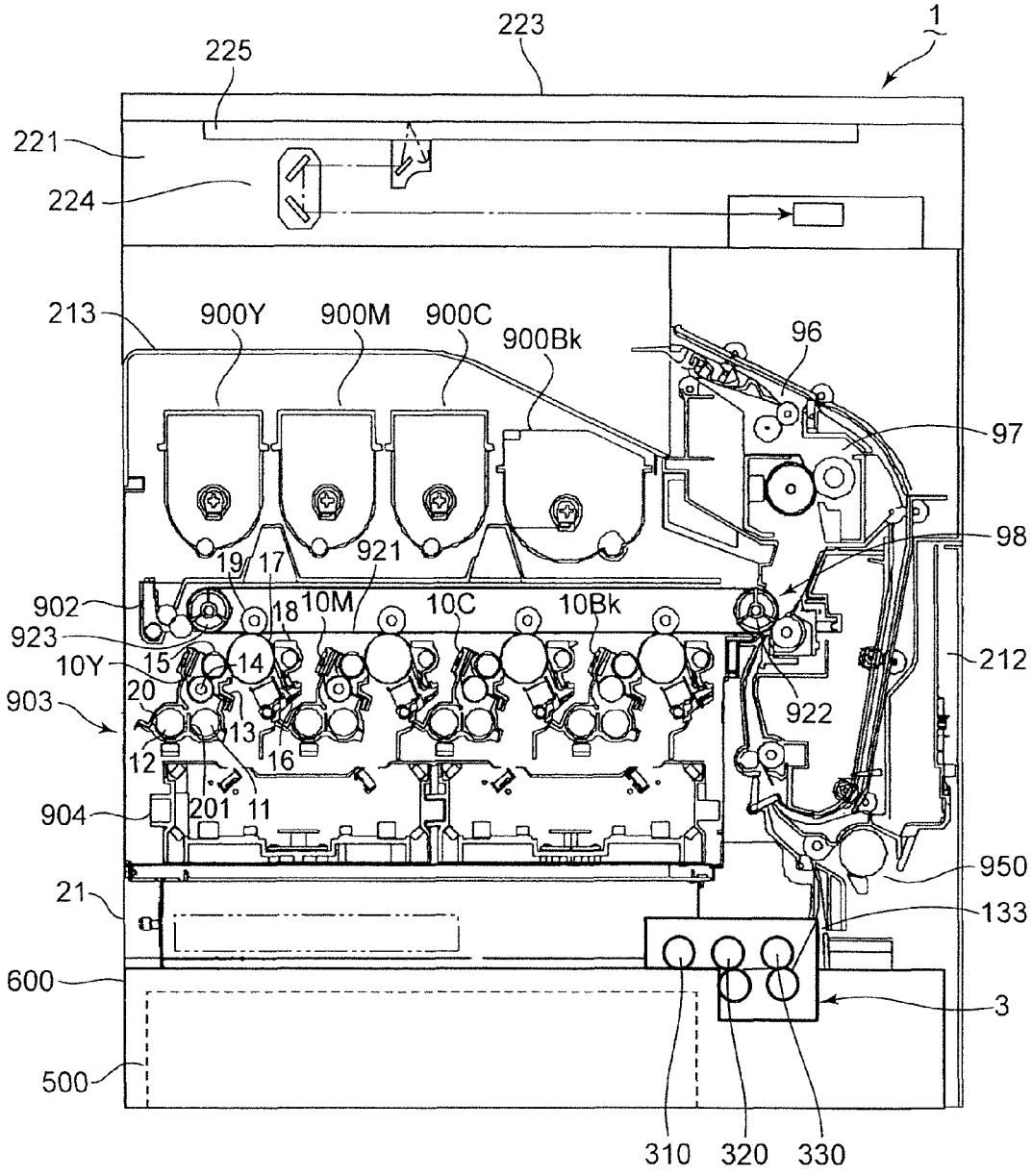
FIG. 2 is a cross section showing the internal configuration of the image forming apparatus shown in FIG. 1.

FIG. 1 is a perspective view of the image forming apparatus according to one embodiment of the present disclosure. FIG. 2 is a diagram schematically showing the internal structure of the image forming apparatus shown in FIG. 1. The image forming apparatus shown in FIG. 1 and FIG. 2 is a so-called internal paper discharge-type copier, but in other embodiments this may also be a printer, a facsimile device, or a multi-function machine having these functions, or another device for forming a toner image on a sheet.

The image forming apparatus 1 includes a substantially rectangular main case 2. The main case 2 includes a substantially rectangular lower case 21, a substantially rectangular upper case disposed above the lower case 21, and a connecting case 23 which connects the lower case 21 and the upper case 22. The connecting case 23 extends along the right edge and rear face edge of the main case 2. The sheets that were subject to print processing are discharged to a discharge space 24 that is enclosed by the lower case 21, the upper case 22 and the connecting case 23.

An operating part 221 which protrudes in a front face direction of the upper case 22 includes, for example, an LCD touch panel 222. The operating part 221 is formed to enable the input of information related to the image forming process. By using the LCD touch panel 222, for example, the user can input the number of sheets to be printed, or input the darkness/lightness of the printing. The upper case 22 mainly houses equipment for reading images from the manuscript and electronic circuits that govern the overall control of the image forming apparatus 1.

A pressure cover 223 disposed on the upper case 22 is used for holding down the manuscript. The pressure cover 223 is mounted on the upper case 22 in a vertically turnable manner. The user turns the pressure cover 223 upward and mounts the manuscript on the upper case 22. Subsequently, the user can operate the operating part 221 and cause the equipment disposed in the upper case 22 to read the image of the manuscript.

A sheet tray 500 for loading a plurality of sheets is disposed in the lower case 21. The sheet tray 500 can be pulled out from the lower case 21 in a front face direction (first direction, arrow D1 direction of FIG. 1). The sheets P housed in the sheet tray 500 are fed upward in the lower case 21 and subject to the image forming process in the lower case 21 based on the instructions input by the user through the operating part 221, and discharged to the discharge space 24.

A tray 212 is turnably mounted on the right face of the lower case 21. As shown in FIG. 1, when the tray 212 is positioned in a manner of protruding rightward of the lower case 21, the user can mount the sheets on the tray 212. The sheets on the tray 212 are pulled into the lower case 21 based on the instructions input by the user through the operating part 221, thereafter subject to the image forming process, and discharged to the discharge space 24. When the tray 212 is turned upward, the tray 212 is housed in a housing space 203 that is provided as a recess on the right face of the lower case 21, and closes a supply port for pulling in the sheets into the lower case 21.

The lower case 21 houses various types of equipment for forming an image on a sheet. Moreover, the connecting case 23 houses various types of equipment for discharging the sheet, which was subject to the image forming process, to the discharge space 24.

FIG. 2 schematically shows the internal structure of the image forming apparatus 1 shown in FIG. 1. The upper case 22 houses a scanning mechanism 224. The user can cause the image forming apparatus 1 to read the image of the intended manuscript through the scanning mechanism 224. A contact glass 225 to be mounted on the top face of the upper case 22 is disposed on the scanning mechanism 224. When the user activates the image forming apparatus 1 through the operating part 221, the scanning mechanism 224 scans and reads the image of the manuscript on the contact glass 225. The analog information of the image read by the scanning mechanism 224 is converted into digital signals. The image forming apparatus 1 forms an image on the sheet based on the digital signals.

The lower case 21 houses toner containers 900Y, 900M, 900C, 900Bk, an intermediate transfer unit 902, an image forming unit 903, an exposure unit 904, a fixing unit 97 and a paper discharge unit 96, and a paper feeding unit 3.

The image forming unit 903 includes a yellow toner container 900Y, a magenta toner container 900M, a cyan toner container 900C, and a black toner container 900Bk. Developing devices 10Y, 10M, 10C, 10Bk corresponding to the respective colors of yellow, magenta, cyan, and black are respectively disposed below the foregoing containers.

The image forming unit 903 includes a photoreceptor drum 17 which carries the toner image of the respective colors. As the photoreceptor drum 17, a photoreceptor drum made from an amorphous silicon (a-Si)-based material may be used. Each photoreceptor drum 17 is supplied with toners of yellow, magenta, cyan and black, respectively, from the developing devices 10Y, 10M, 10C, 10Bk.

A charger 16, developing devices 10 (10Y, 10M, 10C, 10Bk), a transfer unit 19 and a cleaning device 18 are disposed around the photoreceptor drum 17. The charger 16 uniformly charges the surface of the photoreceptor drum 17. The charged surface of the photoreceptor drum 17 is exposed by the exposure unit 904, and an electrostatic latent image is formed thereby. The exposure unit 904 irradiates a laser beam based on the digital signals generated by the foregoing scanning mechanism 224. The developing devices 10Y, 10M, 10C, 10Bk develops (visualizes) the electrostatic latent image formed on the respective photoreceptor drums 17 by using the toners of the respective colors supplied from the respective toner containers 900Y, 900M, 900C, 900Bk. The transfer roller 19 forms a nip part with the photoreceptor drum 17 across an intermediate transfer belt 921, and performs the primary transfer of transferring the toner image on the photoreceptor drum 17 onto the intermediate transfer belt 921. The cleaning device 18 cleans the peripheral face of the photoreceptor drum 17 after the transfer of the toner image.

Each developing device 10Y, 10M, 10C, 10Bk includes a development case 20. A two-component developer including a magnetic carrier and a toner is housed inside the development case 20. Moreover, inside the development case 20, two agitation rollers 11, 12 are rotatably disposed in parallel near the bottom part of the development case 20 with the longitudinal direction as the axial direction.

A circulation pathway of the developer is set at the inner bottom face of the development case 20, and the agitation rollers 11, 12 are disposed in the circulation pathway. A partition wall 201 erected from the bottom part of the development case 20 is provided between the agitation rollers 11, 12 in the axial direction. The partition wall 201 defines the circulation pathway. The circulation pathway is formed so as to circle around the partition wall 201. The two-component developer is charged while being agitated by the agitation rollers 11 and 12 and delivered through the circulation pathway.

The two-component developer circulates within the development case 20 while being agitated by the agitation rollers 11 and 12, and the toner is thereby charged. The two-component developer on the agitation roller 11 is sucked by the magnetic roller positioned on the upper side and thereby delivered. The sucked two-component developer forms a magnetic brush (not shown) on a magnetic roller 14. The layer thickness of the magnetic brush is restricted by a doctor blade 13, and supplies the toner to the developing roller 15 positioned further upward. The toner layer on the developing roller 15 is formed by a potential difference between the magnetic roller 14 and the developing roller 15. An electrostatic latent image is developed on the photoreceptor drum 17 by the toner layer.

The exposure unit 904 includes a light source and various optical equipment such as a polygon mirror, a reflective mirror, and a deflecting mirror, and forms an electrostatic latent image by causing the peripheral face of the photoreceptor drum 17, which is provided to each of the image forming units 903, to be irradiated with light based on the image data.

The intermediate transfer unit 902 has an intermediate transfer belt 921, a drive roller 922 and a driven roller 923. The toner image from a plurality of photoreceptor drums 17 is recoated (primary transfer) on the intermediate transfer belt 921. The recoated toner image is subject to a secondary transfer in the secondary transfer unit 98 of being transferred to a sheet supplied from the sheet tray 500 or the tray 212 (refer to FIG. 1). The drive roller 922 and the driven roller 923 that drives the intermediate transfer belt 921 in a loop are rotatably supported by the lower case 21.

The fixing unit 97 performs fixation processing to the toner image on that sheet that was subject to a secondary transfer from the intermediate transfer unit 902. The sheet with a color image that was subject to the fixation processing is discharged toward the paper discharge unit 96 formed at the top part (in the connecting case 23) of the fixing unit 97.

The paper discharge unit 96 discharges the sheet fed from the fixing unit 97 on the top face 213 of the lower case 21 that is used as the paper discharge tray.

The paper feeding unit 3 is disposed in the lower case 21 in a manner of facing the sheet tray 500. The paper feeding unit 3 includes a pickup roller 310, a paper feeding roller 320, and a transport roller 330. As a result of the pickup roller 310 and the paper feeding roller 320 provided to the paper feeding unit 3 being rotatively driven, the uppermost sheet of the sheet bundle in the sheet tray 500 is fed one by one. In addition, the sheet is delivered to the downstream side of the sheet feeding path 133 by the transport roller 330, and introduced into the image forming unit 903. The pickup roller 310, the paper feeding roller 320, and the transport roller 330 form a part of the sheet feeding path 133 on which the sheet is fed to the image forming unit 903.

<Structure of Sheet Tray>

Figure 3:
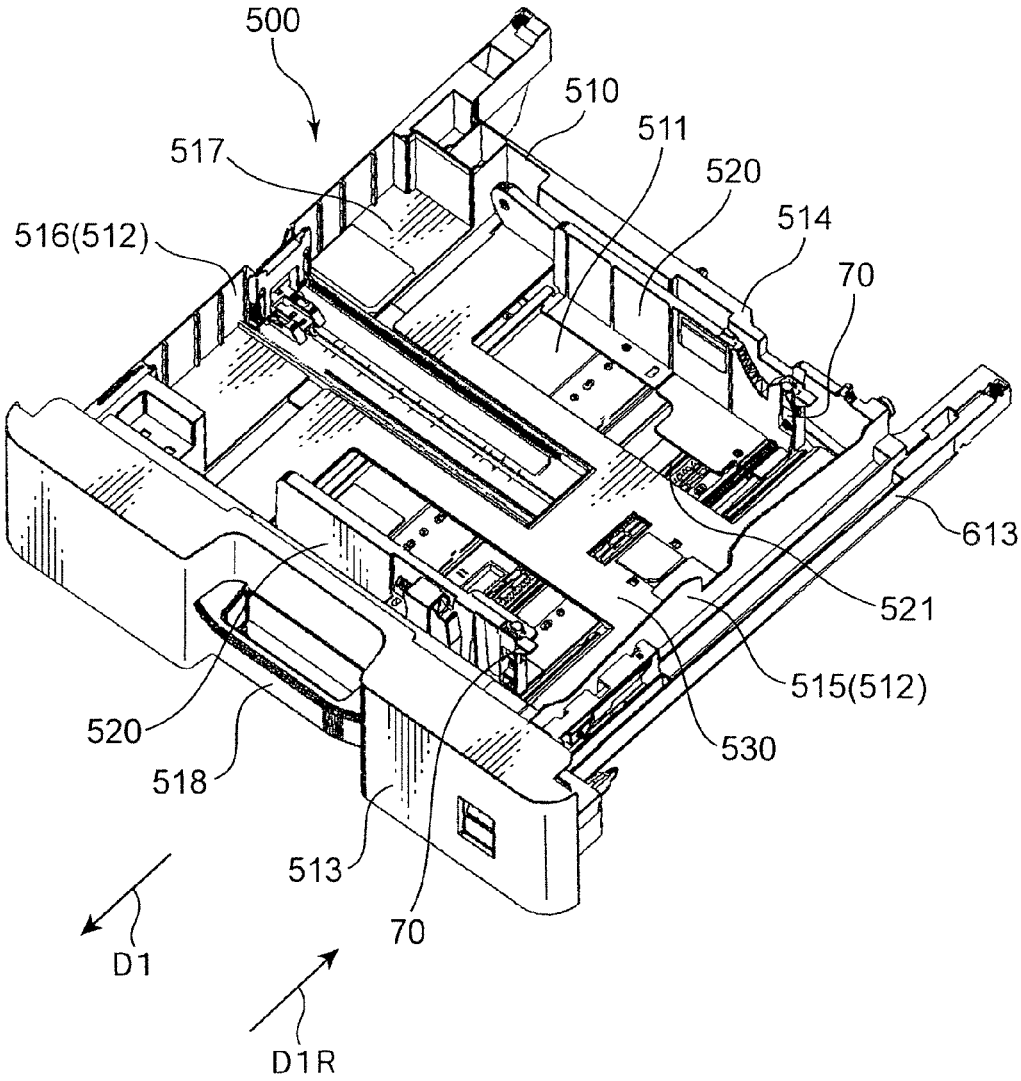
FIG. 3 is a perspective view showing, from above, the sheet tray according to one embodiment of the present disclosure.
Figure 4:
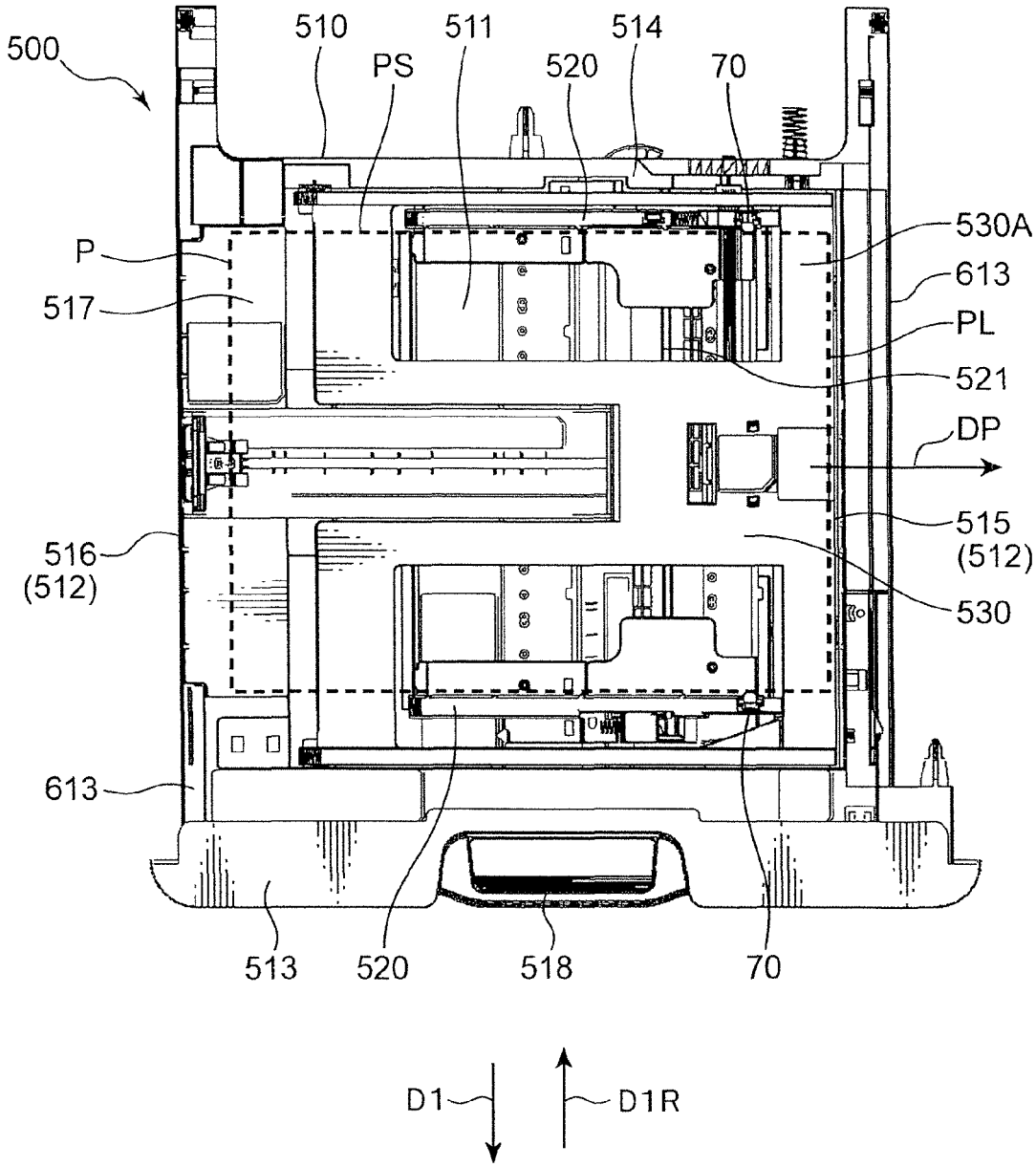
FIG. 4 is a plan view showing, from above, the sheet tray according to one embodiment of the present disclosure.

FIG. 3 is a perspective view showing the sheet tray 500 to be inserted into a housing space 600 (FIG. 2) disposed in the lower case 21, or the sheet tray 500 that is pulled out from the housing space 600. Moreover, FIG. 4 is a plan view of the sheet tray 500.

The sheet tray 500 is formed such that it can be housed in the housing space 600 of FIG. 2. The user pulls the sheet tray 500 out from the housing space 600 upon replenishing sheets in the sheet tray 500, or replacing the sheets in the sheet tray 500 with other sheets. Moreover, the user inserts the sheet tray 500 into the housing space 600 after filling new sheets in the sheet tray 500, or replacing the sheets in the sheet tray 500 with new sheets. When the sheet tray 500 is housed in the housing space 600, the sheet tray 500 retains the sheets in the lower case 21. Movement of the sheet tray 500 in and out of the housing space 600 is guided by a rail 613. In the ensuing explanation, the direction that the sheet tray 500 is pulled out from the housing space 600 (direction heading from the rear face side to the front face side) is referred to as a first direction (arrow D1 direction of FIG. 3 and FIG. 4) for descriptive purposes, and the direction that the sheet tray 500 is inserted into the housing space 600, which is opposite to the first direction, is referred to as the reverse first direction (arrow D1R direction of FIG. 3 and FIG. 4) for descriptive purposes.

The sheet tray 500 includes a sheet tray case 510 which is formed so that it can house the sheets. A sheet housing space for housing the sheets is formed inside the sheet tray case 510. The sheet tray case 510 includes a substantially rectangular bottom wall 511, a lift plate 530 that is laid on the bottom wall 511, a pair of side walls 512 that is erected upward from the peripheral edge of the bottom wall 511, a front face wall 513, and a rear face wall 514. The front face wall 513 which extends between the front face side edge parts of the pair of side walls 512 appears at the outer face of the main case 2 when the sheet tray case 510 is completely housed in the housing space 600. The rear face wall 514 is disposed in a manner of facing the front face wall 513. Of the pair of side walls 512, the side wall positioned on the right side is a downstream wall 515 that is positioned downstream in the feeding direction of the sheets, and the side wall positioned on the left side is an upstream wall 516 that is positioned upstream in the feeding direction of the sheets. Movement of the pair of side walls 512 is respectively guided to the first direction and the reverse first direction of the sheet tray 500 by the rail 613. The front face wall 513 has a substantially U-shaped holding part 518. The user can hold the holding part 518 and move the sheet tray 500 in the first direction and the reverse first direction. The upper edges of the pair of side walls 512, the front face wall 513 and the rear face wall 514 form an opening 517 for housing the sheets in the sheet tray 500. The user can house the sheets in the sheet housing space in the sheet tray case 510 through the opening 517. The lift plate 530 is disposed in the sheet housing space on the bottom wall 511. The lift plate 530 includes a loading face of the sheets P on its top face, and lifts the one edge PL of the sheets P upward.

<Problems Related to Sheet Tray>

In FIG. 4, the sheets P that are loaded in the sheet tray 500 are fed toward the sheet feeding path 133 by the pickup roller 310 (FIG. 2). The sheets P are delivered toward the direction shown with the arrow DP. Here, as a result of the leading end 530A side of the lift plate 530 moving upward, the one edge PL of the sheets P is lifted upward. Consequently, the one edge PL of the sheet P comes into contact with the pickup roller 310 of FIG. 2, and the sheet P is delivered toward the sheet feeding path 133 based on the rotation of the pickup roller 310.

Here, the position of the sheets P in the sheet width direction (first direction, reverse first direction) needs to be restricted to a predetermined position. This is because, if the sheet P is delivered to the sheet feeding path 133 in a state of being displaced in the sheet width direction, the image formed on the sheet P will also become displaced. Thus, disposed is the pair of guide members 520 that restricts the position of the sheets P housed in the sheet tray 500 in the sheet width direction.

The guide members 520 are disposed as a pair respectively on the inner side of the front face wall 513 and the rear face wall 514. The guide members 520 are disposed facing the side edge PS of the sheets which intersects with the one edge PL of the sheets, and restricts the displacement (position) of the sheets disposed on the lift plate 530 in the width direction. A guide groove 521 for guiding the movement of the guide members 520 is formed on the bottom wall 511. The guide groove 521 extends from the front face wall 513 toward the rear face wall 514. Accordingly, the guide member 520 can move in the sheet width direction. In addition, the guide member 520 is moved between a plurality of predetermined fixed positions in the sheet width direction. The fixed positions are set in correspondence with the size of the plurality of types of sheets P. A rack (not shown) having a teeth part formed in a predetermined pitch in the sheet width direction is disposed on the guide member 520. Moreover, a pinion gear not shown which engages with the teeth part is disposed on the bottom wall 511. Of the pair of guide members 520, when one of the guide members 520 is moved in the sheet width direction, the moving force thereof is transmitted to the other guide member 520 based on the engagement of the teeth part of the rack and the pinion gear. Thus, the pair of guide members 520 moves in the sheet width direction in conjunction with each other in mutually opposite directions. Consequently, the guide members 520 are disposed so that they can come into contact with the side edge PS of the sheets in correspondence with the size of the plurality of types of sheets P.

When the guide members are fixed at a predetermined fixed position based on the engagement of the teeth part of the rack and the pinion gear of the guide members, the fixed position of the guide members 520 is determined based on the pitch of the teeth part and the pinion gear. The pitch needs to be set minutely in order to accurately set the restrictive position of the sheets P in the sheet width direction. Nevertheless, when the pitch is set finely, the amount that the tip of the pinion gear will enter the teeth part of the rack will decrease. Thus, the engagement of the teeth part of the rack and the pinion gear will weaken. Consequently, when the sheet tray 500 is inserted into the device body, the guide member 520 may become displaced in the sheet width direction, or the rack may become damaged. In order to resolve the foregoing drawback, the foregoing pitch needs to be secured in a predetermined amount or more. In the foregoing case, a gap will be generated between the guide member and the sheets.

Moreover, the width of the sheets P loaded in the sheet tray 500 has a predetermined tolerance. In other words, the sheet width is slightly different for each sheet P. Thus, when the fixed position of the guide member 520 is set in correspondence with the median value of the tolerance of the sheet width, with the sheets P with a wide sheet width, the side edge PS of the sheets P may become depressed and buckled by the guide member 520. Moreover, with the sheets P having a narrow sheet width, the sheet P may become displaced in the width direction. Accordingly, the fixed position of the guide member 520 is desirably disposed in correspondence with the maximum tolerance of the sheet width of the sheets P. However, in the foregoing case, a gap tends to be generated between the side edge PS of the sheets P and the guide members 520. In order to resolve the foregoing problem, in this embodiment, even in cases where the guide members 520 are disposed at a predetermined fixed position in correspondence with the maximum tolerance of the sheet width of the sheets P and there is a gap between the guide members 520 and the side edge PS of the sheets, the position of the sheets P in the sheet width direction can be accurately restricted with the auxiliary guide member 70.

<Structure of Guide Member>

Figure 5:
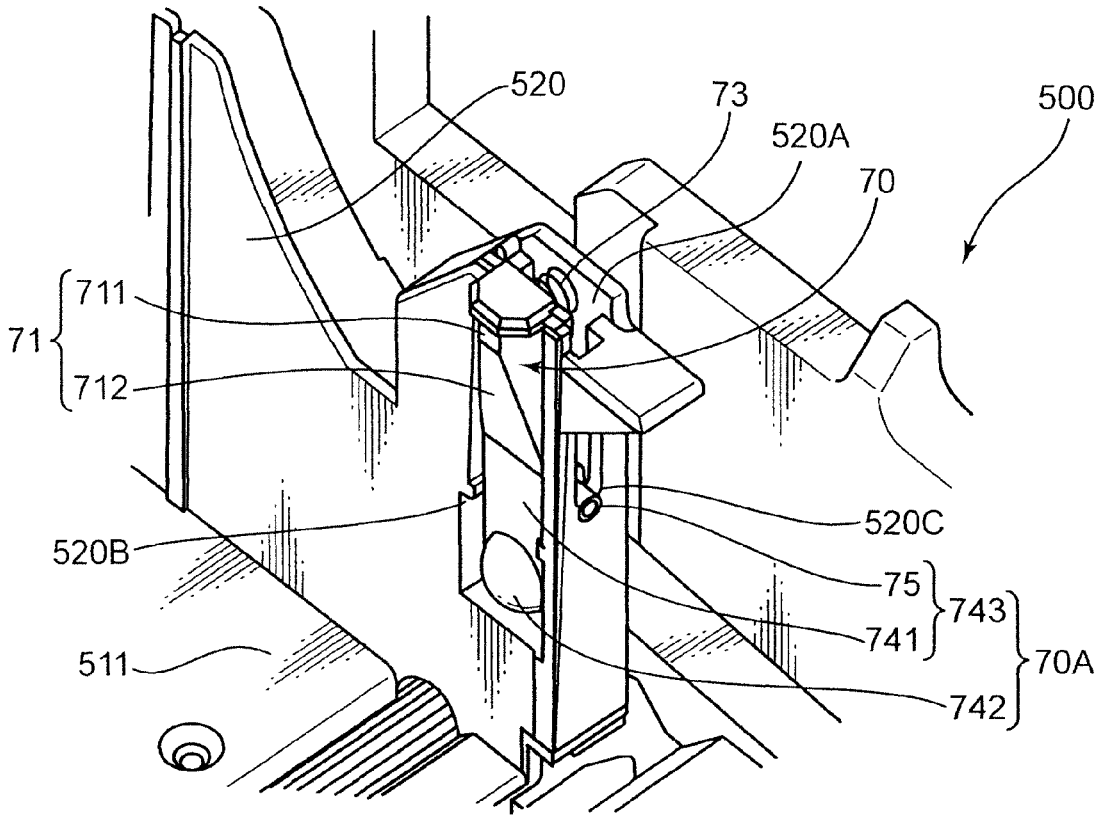
FIG. 5 is a perspective view around the restricting member according to one embodiment of the present disclosure.
Figure 6:
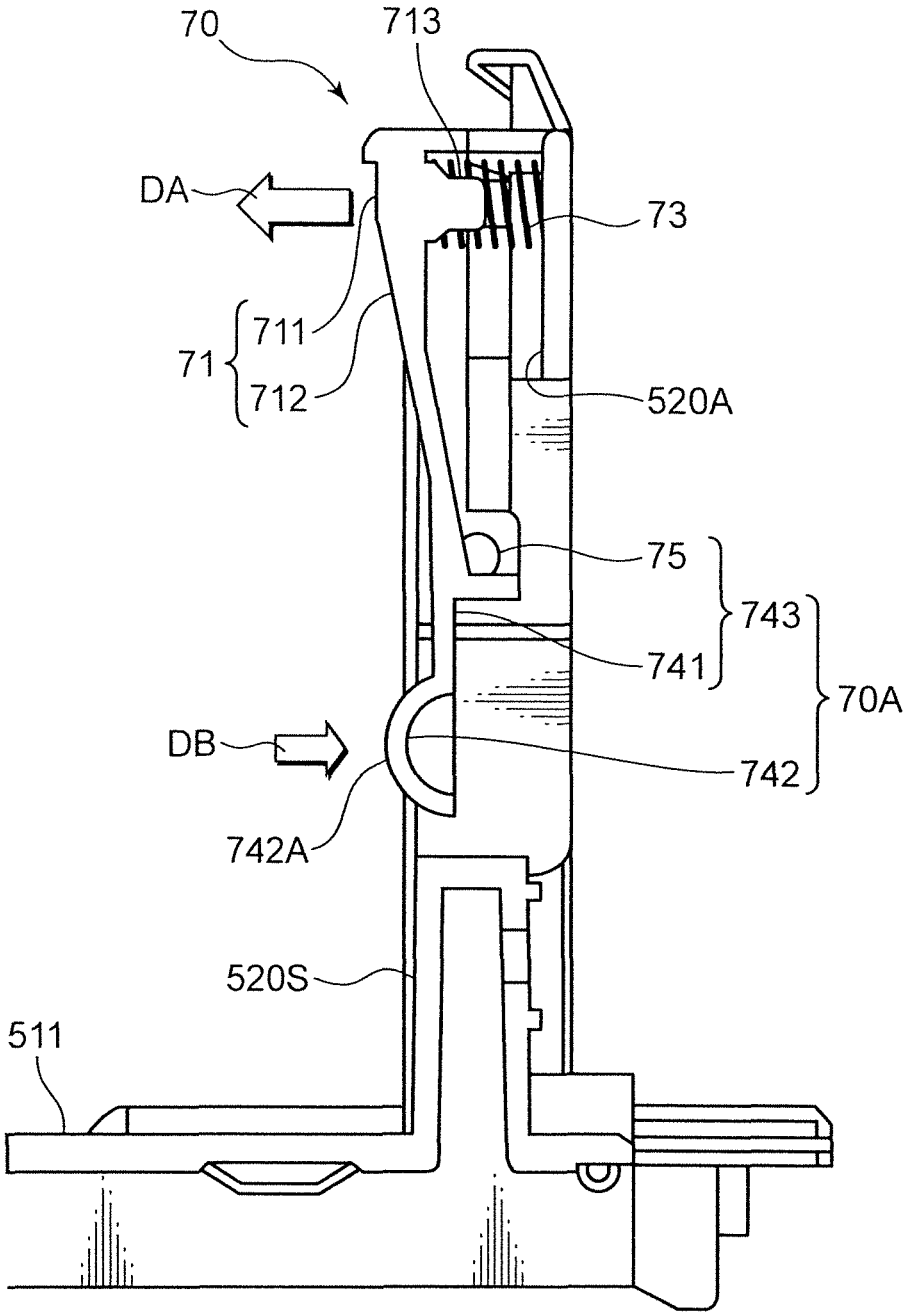
FIG. 6 is a cross section around the restricting member according to one embodiment of the present disclosure.

The auxiliary guide member 70 (auxiliary restricting member) according to an embodiment of the present disclosure is now explained in detail with reference to FIG. 4 to FIG. 6. FIG. 5 is a perspective view around the auxiliary guide member 70 disposed on one end side of the guide member 520, and FIG. 6 is a cross section of the auxiliary guide member 70 in the sheet width direction.

The auxiliary guide member 70 is disposed on the one edge PL side (FIG. 4) of the sheets P in the guide member 520. Moreover, the auxiliary guide member 70 is disposed in a manner of protruding further toward the side edge PS of the sheets housed in the sheet tray 500 than the guide member 520. The auxiliary guide member 70 is a plate-shaped member to be extended in the up-down (vertical) direction, and disposed in the opening 520B formed on one end of the guide member 520. The auxiliary guide member 70 is disposed facing the side edge PS (FIG. 4) of the sheets P housed in the sheet tray 500. The auxiliary guide member 70 includes a restricting piece 71 (first contact part), a biasing spring 73 (first biasing part), and an auxiliary biasing part 70A (second biasing part).

The restricting piece 71 corresponds to the upper portion of the auxiliary guide member 70. The restricting piece has a first restricting part 711, a second restricting part 712, and a protruding piece 713. The first restricting part 711 is configured from a planar surface that is positioned at the upper end of the auxiliary guide member 70 along the vertical direction. Moreover, the protruding piece 713 protrudes from a side that is opposite to the side edge PS of the sheets P of the first restricting part 711 (FIG. 6). The protruding piece 713 has a cylindrically protruding shape. The protruding piece 713 is disposed facing the opposing face 520A, which is one face forming the opening 520B, of the guide members 520. The second restricting part 712 is configured from a planar surface that is connected to the lower end of the first restricting part 711. The second restricting part 712 has an inclined shape that becomes separated downward from the side edge PS of the sheets P. To put it differently, the second restricting part 712 has an inclined surface which is inclined in a direction of approaching the side edge PS of the sheets, in the upper direction of the inclined surface.

The biasing spring 73 is a coil spring with predetermined elastic force. The biasing spring 73 is disposed between the protruding piece 713 of the restricting piece 71 and the opposing face 520A in a compressed state. Biasing force PW1 heading toward the arrow DA direction of FIG. 6 is applied to the restricting piece 71 by the biasing spring 73.

The auxiliary biasing part 70A (auxiliary biasing part) applies biasing force heading toward the side edge PS of the sheets P to the restricting piece 71 when the number of sheets P housed in the sheet tray 500 is large. The auxiliary biasing part 70A is disposed below the restricting piece 71 of the auxiliary guide member 70. The auxiliary biasing part 70A has a third restricting part 742 (second contact part), and a transmission part 743.

The third restricting part 742 is disposed lower than the restricting piece 71, and comes into contact with the side edge PS of the sheets P housed in the sheet tray 500. The third restricting part 742 has a hemispherical shape (hemispherical part) protruding toward the side edge PS of the sheets P housed in the sheet tray 500.

The transmission part 743 is connected to the restricting piece 71 and the third restricting part 742, and moves the restricting piece 71 in a direction that is opposite to the third restricting part 742 in the sheet width direction in connection with the movement of the third restricting part 742 in the sheet width direction. The transmission part 743 has a connecting piece 741, and a rotating shaft 75.

The connecting piece 741 connects the third restricting part 742 and the restricting piece 71. The connecting piece 741 is a plate-shaped member which extends upward from the third restricting part 742. The upper end of the connecting piece 741 is connected to the lower end of the second restricting part 712 of the restricting piece 71.

The rotating shaft 75 is disposed at a position which is the lower end part of the second restricting part 712 and also the upper end part of the connecting piece 741. The rotating shaft 75 is a pair of rotating axes that extends respectively outward from the lower end of the second restricting part 712 (upper end of the connecting piece 741) in the sheet feeding direction (arrow DP direction of FIG. 4, direction that is perpendicular to the plane of paper of FIG. 6). The rotating shaft 75 is inserted through a pair of insert parts 520C formed on a side face of the guide member 520. Note that, in FIG. 5, only one of the insert parts 520C is shown. The rotating shaft 75 is disposed between the restricting piece 71 and the third restricting part 742 in the loading direction of the sheets, and turns the restricting piece 71 and the third restricting part 742 in a cross section that is orthogonal to the side edge PS of the sheets (orthogonal to the under-mentioned restricting face 520S).

Consequently, the auxiliary guide member 70 is disposed such that the restricting piece 71 (first restricting part 711, second restricting part 712) and the third restricting part 742 face the side edge PS of the sheets P housed in the sheet tray 500. The restricting piece 71 and the third restricting part 742 are connected near the pair of rotating axes 75. In addition, the restricting piece 71 and the third restricting part 742 are disposed to turn in mutually opposite directions in the cross section shown in FIG. 6 (cross section including the sheet width direction) around the rotating shaft 75. The disposal of the restricting piece 71 in the sheet width direction in a natural state is determined by the biasing force PW1 of the biasing spring 73. The restricting piece 71 is supported by the rotating shaft while being biased in the arrow DA direction by the biasing spring 73. Here, as shown in FIG. 6, the first restricting part 711 and the upper end parts of the second restricting part 712 formed from a planar surface and the tip 742A of the third restricting part 742 configured from a hemispherical surface are disposed to slightly protrude more to the side edge PS side of the sheets P (arrow DA direction) than the restricting face 520S of the guide member 520 facing the sheets P.

<Operation of Auxiliary Guide Member>

Figure 7:
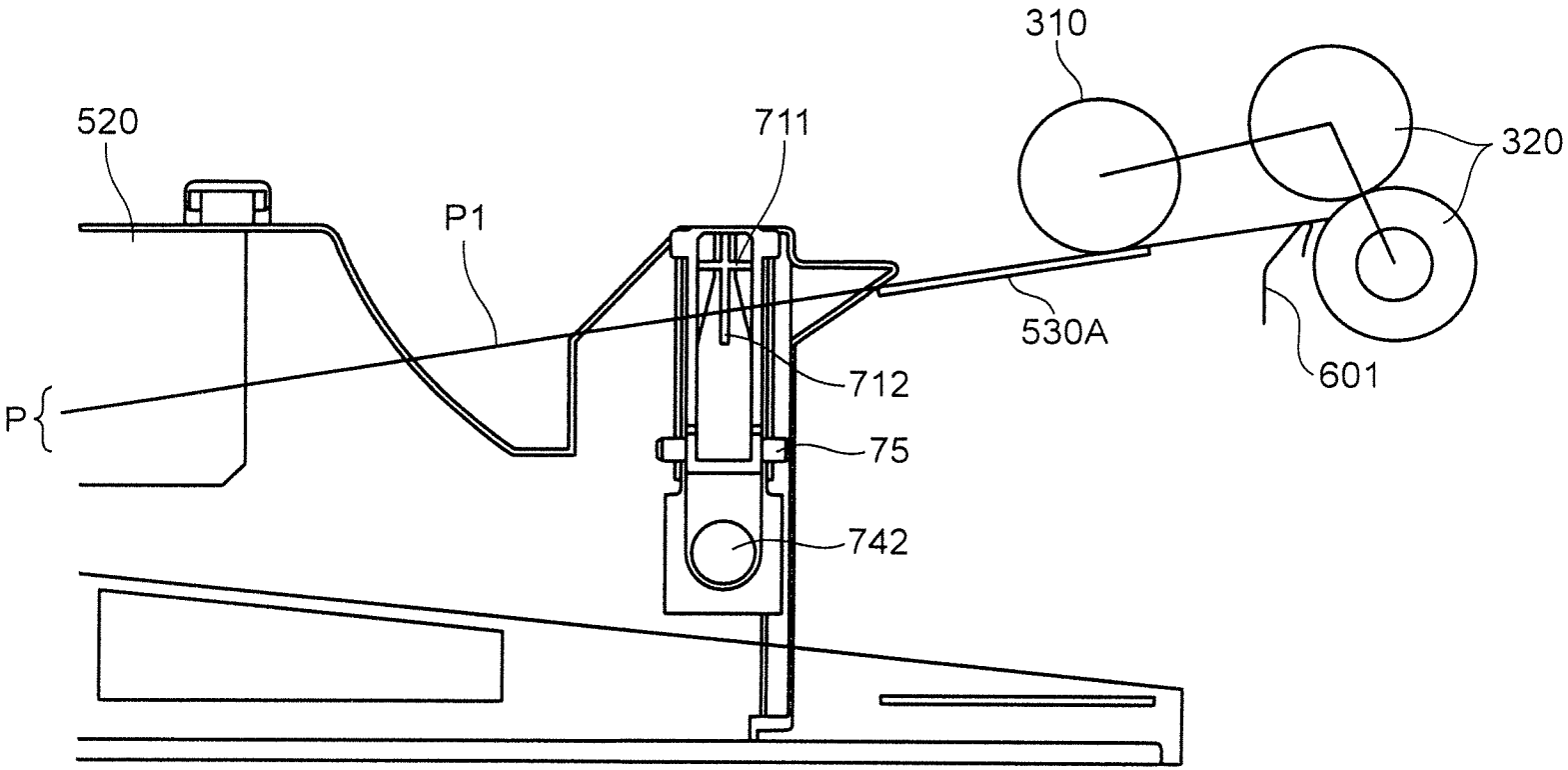
FIG. 7 is a cross section of the sheet tray according to one embodiment of the present disclosure.
Figure 8:
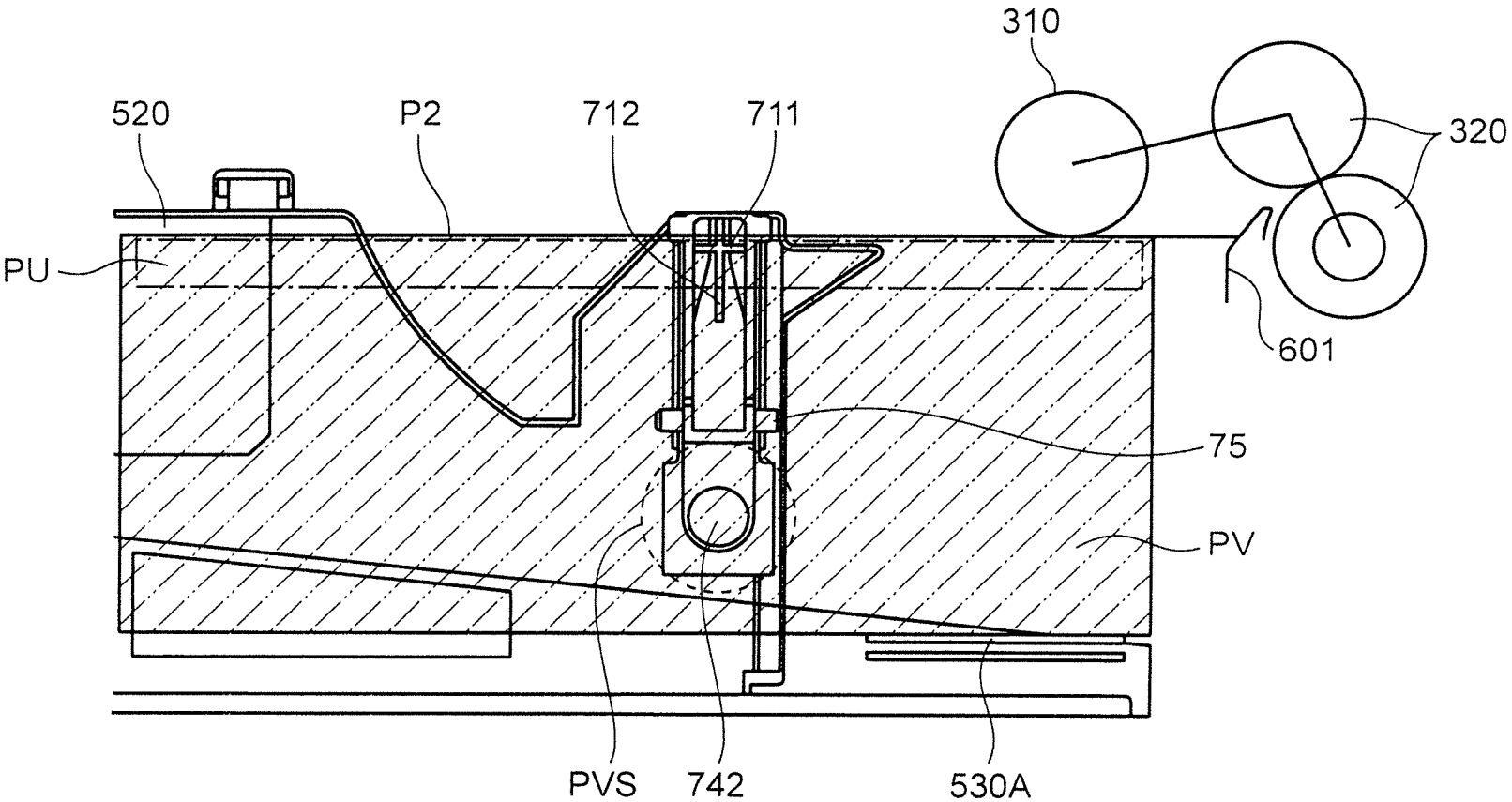
FIG. 8 is a cross section of the sheet tray according to one embodiment of the present disclosure.

The operation of the auxiliary guide member 70 according to this embodiment is now explained. FIG. 7 is a diagram showing the feeding state of the sheets P when a small number of sheets P (first number of sheets) is housed in the sheet tray 500, and FIG. 8 is a diagram showing the feeding state of the sheets P when a large number of sheets P (second number of sheets) is housed in the sheet tray 500. In either case, the guide member 520 is disposed in a predetermined fixed position in correspondence with the sheet width of the housed sheets P. Here, in this embodiment, the spacing of the pair of guide members 520 in the sheet width direction is set to be substantially equal to the maximum tolerance of the sheet width in light of the tolerance of the sheet width of the housed sheets P. In other words, there is a slight gap between the guide member 520 and the side edge PS of the housed sheets P in the amount of tolerance of the sheet width. Thus, the sheets P will not become bent and the side edge PS of the sheets will not buckle as a result of the sheets P being strongly sandwiched by the guide members 520. To put it differently, since the sheets P can move in the width direction in the amount of the gap, an auxiliary position restricting function is required.

In FIG. 7, the number of sheets P housed in the sheet tray 500 is, for example, 10 sheets. When the lift plate 530 is positioned immediately above the bottom wall 511 without moving in the up-down direction, the peripheral face of the pickup roller 310 is unable to come into contact with the sheet P1 disposed at the uppermost position among the 10 sheets P. Thus, as described above, the leading end 530A side of the lift plate 530 lifts the sheet P (P1) upward. Consequently, the leading end of the sheet P in the sheet feeding direction comes into contact with the pickup roller 310, and the sheet P is delivered toward the paper feeding roller 320. Here, the sheet loading face of the lift plate 530 lifts the sheets P up to a position that is higher than the third restricting part 742 of the auxiliary guide member 70. In other words, the sheet loading face of the lift plate 530 is disposed above the third restricting part 742 in a region which the third restricting part 742 of the auxiliary guide member 70 faces when the lift plate 530 is viewed from the third restricting part 742 in the sheet width direction (region which the third restricting part 742 faces in the first direction of FIG. 4 or a direction that is orthogonal to the plane of paper of FIG. 7 of the lift plate 530). Consequently, the side edge PS of the sheets P is restricted by the second restricting part 712 of the restricting piece 71. The restricting piece 71 biases the side edge PS of the sheets P in the arrow DA direction of FIG. 6 based on the biasing force PW1 of the biasing spring 73. As described above, the upper end part of the second restricting part 712 configured from a planar surface is disposed to protrude slightly more to the side edge PS side of the sheets P than the restricting face 520S of the guide member 520 facing the sheet P (FIG. 6). Accordingly, the side edge PS of the sheets P is restricted at a position that is more on the inside of the sheet width direction than the restricting face 520S of the guide member 520. Consequently, the sheet P is delivered toward the sheet feeding path 133 by the pickup roller 310 without being displaced in the sheet width direction. Note that the biasing force PW1 used by the biasing spring 73 to bias the restricting piece 71 is set in advance so that the side edge PS of the sheets P will not become damaged or buckled even when the restricting piece 71 biases the side edge PS of a small number of sheets P.

Meanwhile, in FIG. 8, the number of sheets P housed in the sheet tray 500 is, for example, 500 sheets. In the foregoing case, the sheet bundle PV of the sheets P has a predetermined height. Thus, the leading end 530A of the lift plate 530 will hardly move vertically, and the peripheral face of the pickup roller 310 can come into contact with the sheet P2 disposed at the uppermost position. Meanwhile, when numerous sheets P are housed in the sheet tray 500 as described above, the sheet bundle PV shows behavior like a single rigid body. This is because there is predetermined frictional force on the contact face of the sheets P. In the foregoing case, pressing force that is not less than the biasing force PW1 is required for the first restricting part 711 and the second restricting part 712 to restrict the upper sheet group PU including the sheet P2 in the sheet width direction. When the restricting piece 71 is biased only by the biasing spring 73, the restricting piece 71 is unable to sufficiently depress the upper sheet group PU. In addition, the restricting piece 71 will be depressed by the upper sheet group PU in a direction that is opposite to the side edge PS of the sheets P (direction that is opposite to the arrow DA of FIG. 6). To put it differently, the biasing spring 73 becomes compressed by the pressure of the sheet bundle PV (upper sheet group PU), and the sheet P2 cannot be restricted at its original restrictive position.

Even in the foregoing case, according to this embodiment, the sheet loading face of the lift plate 530 is disposed lower than the third restricting part 742 when the lift plate 530 is viewed from the third restricting part 742 in the sheet width direction. In addition, the third restricting part 742 comes into contact with the side edge part PVS of the sheet bundle PV at a position that is lower than the restricting piece 71. Moreover, the side end part PVS of the sheet bundle PV causes the third restricting part 742 to move in the arrow DB direction of FIG. 6. Here, movement of the third restricting part 742 is transmitted to the restricting piece 71 as the movement in a direction (arrow DA direction) that is opposite to the third restricting part 742 in the sheet width direction with the rotating shaft 75 as the fulcrum. Accordingly, the restricting piece 71 restricts the side edge PS of the upper sheet group PU inward of the sheet width direction with biasing force PW2, which is obtained by adding, to the biasing force PW1 based on the biasing spring 73, biasing force Pa transmitted from the third restricting part 742. In other words, the biasing force PW2 is generated based on the combination of the spring elasticity of the restricting piece 71 and the biasing force of the biasing spring 73. Consequently, in a state where the position of the sheet P2 disposed at the uppermost position is preferably restricted, the sheet P2 is delivered toward the sheet feeding path 133. In other words, when many sheets P (second number of sheets) are housed in the sheet tray 500, the auxiliary biasing part 70A applies biasing force, which leads to the second biasing force PW2, to the restricting piece 71.

Moreover, in this embodiment, of the restricting pieces 71, the second restricting part 712 is configured from an inclined surface, which gradually approaches the side edge PS of the sheets from a lower portion to an upper portion of the inclined surface. In addition, the upper end of the second restricting part 712 is connected to the first restricting part 711. Thus, of the sheet bundle of the loaded sheets P, the sheets P positioned higher are restricted more accurately than the sheets P positioned lower inward in the sheet width direction.

Accordingly, in this embodiment, even in cases where a predetermined gap exists between the pair of guide members 520 and the side edge PS of the sheets P, the position of the sheets P in the width direction is accurately restricted by the auxiliary guide member 70. Thus, there is no need to finely set the predetermined fixed positions of the guide members 520 in the sheet width direction. Consequently, the pitch of the teeth part of the rack and the pinion gear that determines the travel distance of the guide members 520 in the sheet width direction can be set widely. Accordingly it is possible to inhibit the guide member 520 from becoming displaced in the sheet width direction, or the rack becoming damaged by finely setting the pitch when the sheet tray 500 is inserted into the device body.

In addition, in this embodiment, when the number of sheets P housed in the sheet tray 500 is small (first number of sheets), the lift plate 530 is moved higher than the third restricting part 742, and when the number of sheets P housed in the sheet tray 500 is large (second number of sheets), the lift plate 530 is set to be positioned lower than the third restricting part 742. Thus, in cases where the number of sheets is not less than a predetermined number of sheets, the third restricting part 742 faces the sheet side edge PS. In addition, the sheet side edge PS depresses the third restricting part 742 outward in the sheet width direction. Accordingly, auxiliary biasing force can be applied to the restricting piece 71 according to the number of sheets to be loaded.

As described above, according to the foregoing embodiment, the sheet tray 500 for housing a plurality of sheets is provided with the guide members 520 which restrict the position of the sheets in the sheet width direction. The guide members 520 can move between a plurality of predetermined fixed positions, and are disposed to face the side edge PS of the sheets. The one edge PL of the sheets loaded in the sheet tray 500 is lifted upward by the lift plate 530. Even if the sheets loaded in the sheet tray 500 are of the same type, there is tolerance of the sheet width. Accordingly, when the guide members 520 are disposed in correspondence with the maximum value of tolerance of the sheet width, with sheets having a narrow sheet width, a gap is generated between the side edge PS of the sheets and the guide member 520. Even in the foregoing case, according to the foregoing configuration, the auxiliary guide member 70 is disposed on the one edge PL side of the guide member 520. The auxiliary guide member 70 restricts the side edge PS of the sheets lifted by the lift plate 530 based on the first biasing force PW1 when the number of sheets housed in the sheet tray 500 is the first number of sheets. Moreover, the auxiliary guide member 70 restricts the side edge PS of the sheets lifted by the lift plate 530 based on the second biasing force PW2, which is greater than the first biasing force PW1, when the number of sheets housed in the sheet tray 500 is the second number of sheets, which is greater than the first number of sheets. Thus, when the number of sheets is the first number of sheets where the sheets can be easily restricted in the sheet width direction, the auxiliary guide member 70 restricts the sheet position based on the first biasing force PW1. In addition, when the number of sheets is the second number of sheets which requires greater force for restricting the sheets in the sheet width direction in comparison to the first number of sheets, the auxiliary guide member 70 restricts the sheet position based on the second biasing force PW2. Accordingly, the guide members 520 that are disposed at the fixed position will be disposed in correspondence with the maximum tolerance of the sheet width, and, even when a gap is generated between the side edge PS of the sheets and the guide member 520, the auxiliary guide member can restrict the position of the sheets in the sheet width direction according to the number of sheets. Consequently, there is no need to finely set the fixed position of the guide members 520, and the fixed structure of the guide members 520 can be reinforced.

Moreover, according to the foregoing embodiment, the restricting piece 71 comes into contact with the side edge PS of the sheets lifted by the lift plate 530. Here, the restricting piece 71 is biased by the biasing spring 73 toward the side edge PS side of the sheets based on the first biasing force PW1. In addition, when the number of loaded sheets is the second number of sheets, the auxiliary biasing part 70A applies biasing force, which heads toward the side edge PS of the sheets, to the restricting piece 71. Here, the auxiliary biasing part 70A applies the biasing force so that the restricting piece 71 will have the second biasing force PW2. Thus, different biasing force can be applied to the restricting piece 71 according to the number of sheets.

Moreover, according to the foregoing embodiment, the third restricting part 742 which comes into contact with the side edge PS of the sheets housed in the sheet tray 500 is disposed lower than the restricting piece 71. When the second number of sheets is loaded in the sheet tray 500, the side edge PS of the sheets positioned lower than the restricting piece 71 depresses the third restricting part 742 outward in the sheet width direction. Here, the moving force of the third restricting part 742 is transmitted in a direction that is opposite to the third restricting part 742 in the sheet width direction relative to the restricting piece 71 by the transmission part 743. Consequently, the restricting piece 71 is subject to the second biasing force PW2 heading toward the inside of the sheet width direction. Accordingly, when the second number of sheets is loaded in the sheet tray 500, the pressing force of the sheets depressing the third restricting part 742 can be converted into the biasing force of the restricting piece 71.

Moreover, according to the foregoing embodiment, since the side edge PS of the sheets does not face the third restricting part 742 when the number of sheets is the first number of sheets, the biasing force applied to the restricting piece 71 will not reach the second biasing force PW2. Meanwhile, when the number of sheets is the second number of sheets, the sheet loading face of the lift plate 530 is disposed lower than the third restricting part 742 when the lift plate 530 is viewed from the third restricting part 742 in the sheet width direction. Thus, when the number of sheets is greater than a predetermined number of sheets, the third restricting part 742 faces the side edge PS of the sheets, and the side edge PS of the sheets depresses the third restricting part 742 outward in the sheet width direction. Accordingly, the second biasing force PW2 can be applied to the restricting piece 71 according to the number of sheets to be loaded.

Moreover, according to the foregoing embodiment, the restricting piece 71 and the third restricting part 742 are turnably disposed around the rotating shaft 75 in a cross section that is orthogonal to the side edge PS of the sheets. Thus, the pressing force applied to the third restricting part 742 can be transmitted to the restricting piece 71 based on a simple structure of the transmission part 743.

Moreover, according to the foregoing embodiment, the restricting piece 71 includes an inclined surface, which gradually approaches the side edge of the sheets from a lower portion to an upper portion of the inclined surface. Thus, of the sheets loaded in the sheet tray 500, the position of the sheets positioned upward in the sheet width direction can be accurately restricted.

Moreover, according to the foregoing embodiment, the third restricting part 742 has a hemispherical shape which protrudes toward the side edge PS of the sheets in a cross section view of the sheet width direction (in a cross section view including the sheet width direction). Thus, the sheets will not be damaged easily even when the side edge PS of the sheets come into contact with the third restricting part 742 when the sheets P are lifted upward by the lift plate 530. Moreover, if the number of sheets is the second number of sheets, the sheets will not be damaged easily when the side edge PS of the sheets depresses the third restricting part 742.

The auxiliary guide member 70 according to the present disclosure, and the sheet tray 500 including the auxiliary guide member 70 were explained above, but the present disclosure is not limited to the foregoing embodiments. For instance, the following modified embodiments may also be adopted.

(1) In the foregoing embodiment, the transmission part 743 was explained as being configured from the connecting piece 741 and the rotating shaft 75, but the configuration of the transmission part 743 is not limited thereto. The transmission part 743 may also be a plate spring member or the like which connects the third restricting part 742 and the restricting piece 71. In the foregoing case also, the restricting piece 71 can be moved in a direction that is opposite to the third restricting part 742 in the sheet width direction in connection with the movement of the third restricting part 742 in the sheet width direction.

(2) In the foregoing embodiment, the restricting piece was explained as being configured from the first restricting part 711 and the second restricting part 712, but the configuration of the restricting piece 71 is not limited thereto. The restricting piece 71 may also have the shape of either the first restricting part 711 or the second restricting part 712, or have another shape which restricts the side edge PS of the sheets P.

(3) Moreover, in the foregoing embodiment, the third restricting part 742 was explained as being formed in a hemispherical shape which protrudes toward the side edge PS of the sheets P, but the shape of the third restricting part 742 is not limited thereto. For example, the third restricting part 742 may also be a member having an arc shape or a curved part which protrudes toward the side edge PS of the sheets P. Accordingly, as a result of the third restricting part 742 having an arc shape or a curved part in addition to the foregoing hemispherical shape, the sheets P will not be damaged easily even when the side edge PS of the sheets P come into contact with the third restricting part 742 when the sheets P are lifted upward by the lift plate 530. Moreover, if the number of sheets to be housed in the sheet tray 500 is large, the sheets P will not be damaged easily when the side edge PS of the sheets P depresses the third restricting part 742. Moreover, the third restricting part 742 may also be a flat plate-shaped member without having a hemispherical shape or a curved part.

(4) In addition, in the foregoing embodiment, explained was the difference between the biasing force PW1 used by the restricting piece 71 for biasing the side edge PS of the sheets P when the number of sheets P to be loaded in the sheet tray 500 is small, and the biasing force PW2 used by the restricting piece 71 for biasing the side edge PS of the sheets P when the number of sheets P to be loaded in the sheet tray 500 is large. In cases where the auxiliary guide member 70 is to restrict the position of the sheets P, the restrictive position where the restricting piece 71 restricts the side edge PS of the sheets P when the number of sheets P is large may be more on the inside in the sheet width direction (position that is closer to the side edge PS of the sheets P or the lift plate 530) than the restrictive position where the restricting piece 71 restricts the side edge PS of the sheets P when the number of sheets P is small. If the restricting piece 71 excessively comes into contact with the side edge PS of the sheets P when the number of sheets P is small, the sheets P may become damaged. However, when the number of sheets P is large, the sheets P will not be damaged easily since the contact pressure by the restricting piece 71 is distributed. Accordingly, in cases where the number of sheets is large and the greater energy is required for the positional restriction of the sheets, the position of the sheets P can be restricted more on the inside in the sheet width direction.

(5) Moreover, in the foregoing embodiment, a mode was explained where, when the number of sheets P (second number of sheets) housed in the sheet tray 500 is large, the biasing force PW2 is generated based on the combination of the spring elasticity of the restricting piece 71 and the biasing force of the biasing spring 73, but the mode of the biasing force PW2 is not limited thereto. The biasing force PW2 may also be generated only based on the rotation of the restricting piece 71 in connection with the third restricting part 742 being depressed by the side edge PS of the sheets P.

(6) Moreover, in the foregoing embodiment, a sheet tray having a cassette structure was explained as the sheet loading device on which a plurality of sheets are loaded, but the present disclosure is not limited thereto. The present disclosure may also be applied to a manuscript transfer device that transfers the manuscript sheet to a predetermined reading position, or a bypass tray on which the sheets are loaded as the sheet loading device.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet loading device, comprising:

a sheet tray that has a sheet housing space for housing a plurality of sheets;

a lift plate disposed in the sheet housing space, the lift plate having a top face as a loading face for loading the sheets, and lifts one edge of the sheets upward;

a guide member that is movable among a plurality of predetermined fixed positions, the guide member being disposed facing a side surface of the sheets that intersects with the one edge of the sheets and being configured to restrict a position of the sheets in a sheet width direction; and an auxiliary restricting member disposed on the one edge side of the guide member and protruding farther toward the side surface of the sheets housed in the sheet tray than the guide member, the auxiliary restricting member restricting the side surface of the sheets lifted by the lift plate by biasing the side surface with a first biasing force when the number of sheets housed in the sheet tray is a first number of sheets, and restricting the side surface of the sheets lifted by the lift plate by biasing the side surface with a second biasing force that is greater than the first biasing force when the number of sheets housed in the sheet tray is a second number of sheets that is greater than the first number of sheets, the auxiliary restricting member including:

a first contact part that comes into contact with the side surface of the sheets lifted by the lift plate;

a first biasing part that biases the first contact part, with the first biasing force, toward the side surface of the sheets housed in the sheet tray; and a second biasing part that applies to the first contact part a biasing force that leads to the second biasing force when the number of sheets housed in the sheet tray is the second number of sheets, the second biasing part including a second contact part that is disposed lower than the first contact part, and comes into contact with the side surface of the sheets housed in the sheet tray, and a transmission part that is connected to the first contact part and the second contact part, and that, in connection with a movement of the second contact part in the sheet width direction, moves the first contact part in a direction that is opposite to the movement of the second contact part in the sheet width direction.

2. The sheet loading device according to claim 1, wherein the second contact part has a hemispherical part which protrudes toward the side surface of the sheets housed in the sheet tray.

3. The sheet loading device according to claim 1, wherein the auxiliary restricting member is movable in the sheet width direction.

4. The sheet loading device according to claim 1, wherein when the lift plate is viewed from the second contact part in the sheet width direction, the sheet loading face of the lift plate is disposed higher than the second contact part when the number of sheets housed in the sheet tray is the first number of sheets, and the sheet loading face of the lift plate is disposed lower than the second contact part when the number of sheets housed in the sheet tray is the second number of sheets.

5. The sheet loading device according to claim 1, wherein the transmission part includes a rotating shaft which is disposed between the first contact part and the second contact part in a loading direction of the sheets, and rotates the first contact part and the second contact part in a cross section that is orthogonal to the side surface of the sheets.

6. The sheet loading device according to claim 1, wherein the first contact part includes an inclined surface, which gradually approaches the side surface of the sheets housed in the sheet tray from a lower portion to an upper portion of the inclined surface.

7. The sheet loading device according to claim 1, wherein the second contact part has an arc shape which protrudes toward the side surface of the sheets housed in the sheet tray in a cross sectional view of the sheet width direction.

8. A sheet loading device, comprising:

a sheet tray on which a plurality of sheets are loaded;

a lift plate disposed below the sheets in the sheet tray, and lifts one end side of the sheets upward;

a guide member that is movable to a plurality of predetermined fixed positions, the guide member being disposed opposite to a side surface of the sheets that intersects with the one edge of the sheets and being configured to restrict a position of the sheets in a sheet width direction; and an auxiliary restricting member disposed on the one edge side of the guide member and protruding farther toward the side surface of the sheets loaded on the sheet tray than the guide member, the auxiliary restricting member, at a first position, restricting the side surface of the sheets lifted by the lift plate when the number of sheets loaded on the sheet tray is a first number of sheets, and, at a second position, restricting the side surface of the sheets lifted by the lift plate when the number of sheets loaded on the sheet tray is a second number of sheets that is greater than the first number of sheets, the auxiliary restricting member at the second position protruding from the guide member farther toward the sheets than the auxiliary restricting member at the first position in the sheet width direction, the auxiliary restricting member including:

a first contact part that comes into contact with the side surface of the sheets lifted by the lift plate;

a biasing part that biases the first contact part toward the side surface of the sheets loaded on the sheet tray with a biasing force; and a second contact part that is disposed lower than the first contact part and comes into contact with the side surface of the sheets loaded on the sheet tray when the number of sheets loaded on the sheet tray is at least the second number, and a transmission part that connects the first contact part to the second contact part so that a movement of the second contact part in the sheet width direction moves the first contact part in a direction that is opposite to the movement of the second contact part in the sheet width direction for further urging the first contact part toward the side surface of the sheets.

9. The sheet loading device according to claim 8, wherein the auxiliary restricting member is movable in the sheet with direction.

10. An image forming apparatus, comprising:

an image forming unit that forms an image on a sheet;

a sheet loading device in which the sheet is loaded; and a sheet feeding path that extends from a sheet tray to the image forming unit and on which the sheet is fed, wherein the sheet loading device includes:

the sheet tray on which a plurality of sheets are loaded;

a lift plate disposed below the sheets in the sheet tray, the lift plate having a top face on which the sheets are loaded, and lifts one end side of the sheets upward;

a guide member that is movable to a plurality of predetermined fixed positions, the guide member being disposed opposite to a side surface of the sheets that intersects with the one edge of the sheets, the guide member being configured to restrict a position of the sheets in a sheet width direction; and an auxiliary restricting member which is disposed on the one edge side of the guide member and protruding farther toward the side surface of the sheets housed in the sheet tray than the guide member, the auxiliary restricting member restricting the side of surface of the sheets lifted by the lift plate by biasing the side surface with a first biasing force when the number of sheets housed in the sheet tray is a first number of sheets, and restricting the side surface of the sheets lifted by the lift plate by biasing the side surface with a second biasing force that is greater than the first biasing force when the number of sheets housed in the sheet tray is a second number of sheets that is greater than the first number of sheets, the auxiliary restricting member including:

a first contact part that comes into contact with the side surface of the sheets lifted by the lift plate;

a first biasing part that biases the first contact part, with the first biasing force, toward the side surface of the sheets housed in the sheet tray; and a second biasing part that applies to the first contact part a biasing force that leads to the second biasing force when the number of sheets housed in the sheet tray is the second number of sheets, the second biasing part including a second contact part that is disposed lower than the first contact part, and comes into contact with the side surface of the sheets housed in the sheet tray, and a transmission part that is connected to the first contact part and the second contact part, and that, in connection with a movement of the second contact part in the sheet width direction, moves the first contact part in a direction that is opposite to the movement of the second contact part in the sheet width direction.

11. The image forming apparatus according to claim 10, wherein the second contact part has a hemispherical part which protrudes toward the side surface of the sheets housed in the sheet tray.

12. The image forming apparatus according to claim 10, wherein the auxiliary restricting member is movable in the sheet width direction.

13. The image forming apparatus according to claim 10, wherein when the lift plate is viewed from the second contact part in the sheet width direction, the sheet loading face of the lift plate is disposed higher than the second contact part when the number of sheets housed in the sheet tray is the first number of sheets, and the sheet loading face of the lift plate is disposed lower than the second contact part when the number of sheets housed in the sheet tray is the second number of sheets.

14. The image forming apparatus according to claim 10, wherein the transmission part includes a rotating shaft which is disposed between the first contact part and the second contact part in a loading direction of the sheets, and rotates the first contact part and the second contact part in a cross section that is orthogonal to the side surface of the sheets.

15. The image forming apparatus according to claim 10, wherein the first contact part includes an inclined surface, which gradually approaches the side surface of the sheets housed in the sheet tray from a lower portion to an upper portion of the inclined surface.

16. The image forming apparatus according to claim 10, wherein the second contact part has an arc shape which protrudes toward the side surface of the sheets housed in the sheet tray in a cross sectional view of the sheet width direction.

* * * * *